US011821246B1

(12) United States Patent
Paskuski

(10) Patent No.: US 11,821,246 B1
(45) Date of Patent: Nov. 21, 2023

(54) DOORSTOP

(71) Applicant: Gary Brian Paskuski, Rockyview County (CA)

(72) Inventor: Gary Brian Paskuski, Rockyview County (CA)

( * ) Notice: Subject to any disclaimer, the term of this patent is extended or adjusted under 35 U.S.C. 154(b) by 0 days.

(21) Appl. No.: 17/992,848

(22) Filed: Nov. 22, 2022

(51) Int. Cl.
*E05F 5/02* (2006.01)
*E05C 17/54* (2006.01)

(52) U.S. Cl.
CPC ..... *E05C 17/54* (2013.01)

(58) Field of Classification Search
CPC ..... E05C 17/00; E05C 17/46; E05C 17/54; E05C 17/44; E05C 17/025; E05F 5/02; E05F 5/04; E05F 5/06; E05F 5/00; E05F 2005/046; E05Y 2900/132; E05Y 2201/212; E05Y 2201/224; Y10T 292/71; Y10T 292/73
See application file for complete search history.

(56) References Cited

U.S. PATENT DOCUMENTS 1,944,101 A * 1/1934 Meier ..... E05F 5/06 16/86 A
3,055,043 A * 9/1962 Luttner, Jr. ..... E05F 5/04 292/87
5,027,471 A * 7/1991 Barnes ..... E05D 11/00 292/288
5,369,840 A * 12/1994 Salvador ..... E05C 17/54 16/83
5,511,837 A * 4/1996 Dempsey ..... E05D 11/1014 292/288
6,003,911 A * 12/1999 Sowash ..... E05C 17/025 292/288
D578,872 S * 10/2008 Healy ..... D8/402
D604,156 S * 11/2009 Healy ..... D8/402
8,458,958 B2 * 6/2013 Cress ..... E05F 5/04 16/86 A
8,727,404 B2 * 5/2014 Martin ..... E05B 17/005 292/341.14
9,127,489 B2 * 9/2015 Orlov ..... E05C 17/54
9,328,546 B1 * 5/2016 Davis ..... E06B 7/362
9,644,414 B1 * 5/2017 Earp, Jr. ..... E05F 5/02
10,801,238 B1 * 10/2020 Cox ..... E05C 17/025
D939,949 S * 1/2022 Li ..... D8/402
2005/0161954 A1 * 7/2005 Miskin ..... E05F 5/02 292/229
2006/0032017 A1 * 2/2006 Agster ..... E05D 11/00 16/86 R
2007/0126248 A1 * 6/2007 Mintz ..... E05C 17/025 292/342
2008/0277949 A1 * 11/2008 Emde ..... E05C 17/025 292/343
2009/0260182 A1 * 10/2009 Hall ..... E05C 17/025 16/82
2010/0242226 A1 * 9/2010 Hopkins ..... E05C 17/54 16/82

(Continued)

*Primary Examiner* — Chuck Y Mah

(57) ABSTRACT

A doorstop includes a bulb-shaped head portion, a tail portion, and a notch formed in a distal end of the tail portion. The doorstop is a one-piece apparatus molded from non-toxic rubber and adapted to be positioned in a gap above a hinge between a doorframe and a door to prevent the door from full closure. For storage of the doorstop, the tail portion can wrap around a door knob and insert into the notch to retain the doorstop in place.

1 Claim, 2 Drawing Sheets

(56) References Cited

U.S. PATENT DOCUMENTS

| | | | | |
|---|---|---|---|---|
| 2012/0060421 | A1* | 3/2012 | Wong | E05C 17/025 49/383 |
| 2013/0118087 | A1* | 5/2013 | Belyea | E06B 7/362 49/506 |
| 2017/0226782 | A1* | 8/2017 | Holden | E05C 17/54 |

* cited by examiner

DOORSTOP

BACKGROUND OF THE INVENTION

Typically, door stops are, permanently or semi-permanently, attached to a door, to a door's hardware, or to the floor, baseboard, or other hard surface around the door. "Latches" or other means are usually used to keep the door from moving from a fully-opened position to a fully-closed position. This door stop is neither permanent nor semi-permanent but still restricts the door from full closure. Not only is it portable but there is no tooling, damage, or alteration to anything on, around, or near the door.

SUMMARY OF THE INVENTION

Made of one solid piece of non-toxic rubber, the door stop is placed through the space between the door jamb 6 and door spine 7, over any of the hinges 4, when the door is resting in full-open or mostly full-open position. The rubber "bulb" acts as a "brake" to stop the door from full closure. The "tail 2" acts as a stay to keep the door stop in place.

The rubber construction of the door stop eliminates any damage to the door, door jamb 6, or any other surfaces around the door. Restraining the door from full closure, acts as a safety mechanism for infants and small children, where a rapidly-closing door can cause bodily harm. It also allows for any rapid closure from wind or outside force. The rubber is non-toxic, thus environmentally safe.

Finally, the "tail 2" of the door stop is "notched", to enable "on-site" storage. Simply join the notch 3 to the tail 2 behind the head 1, while wrapping the door stop around the door handle for easy storage.

DETAILED DESCRIPTION OF THE INVENTION

Figure 1A:
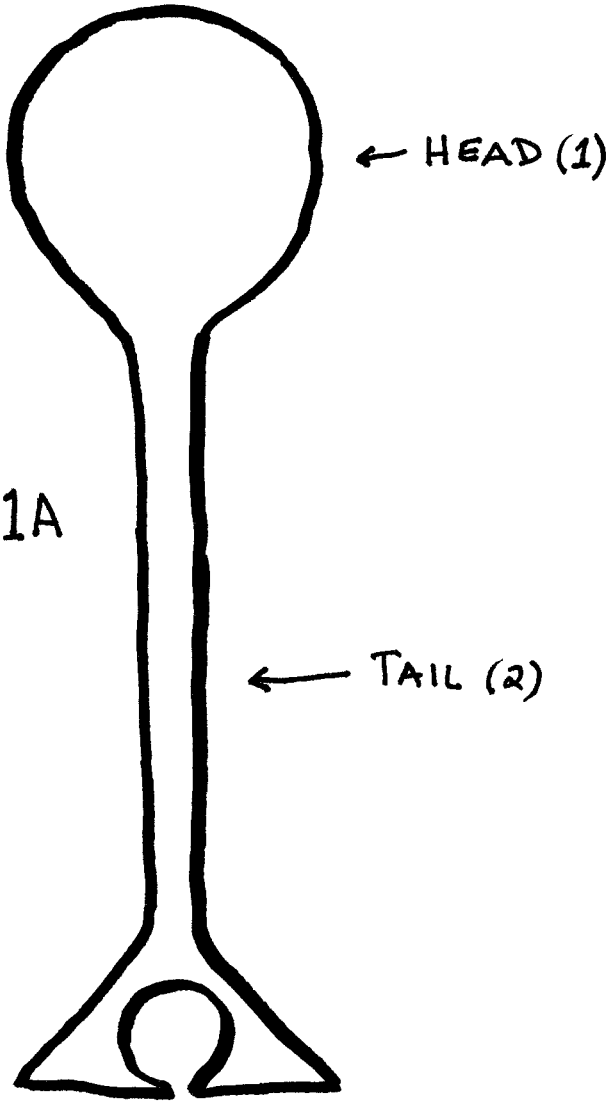
FIG. 1A Shape and Form (top view)—drawing of the door stop, when viewed from above, while resting on a flat surface, proper-side up.
Figure 1B:
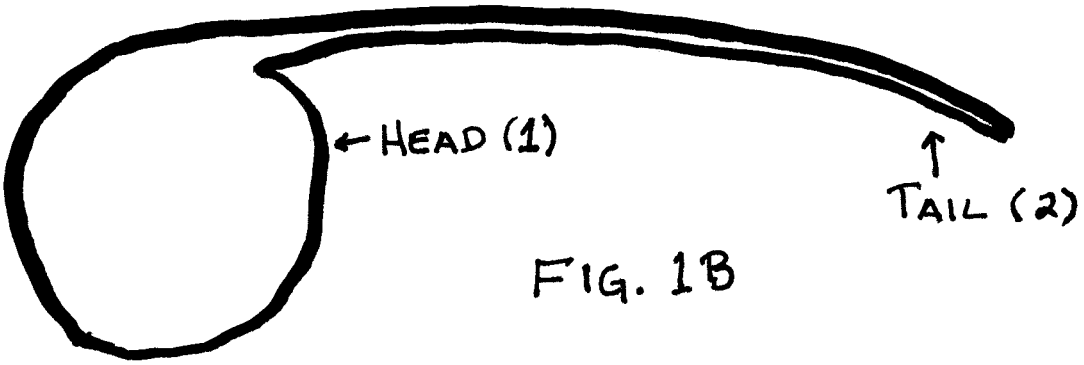
FIG. 1B Shape and Form (side view)—drawing of the door stop, when viewed from the side, while resting on a flat surface, proper-side up.
Figure 2:
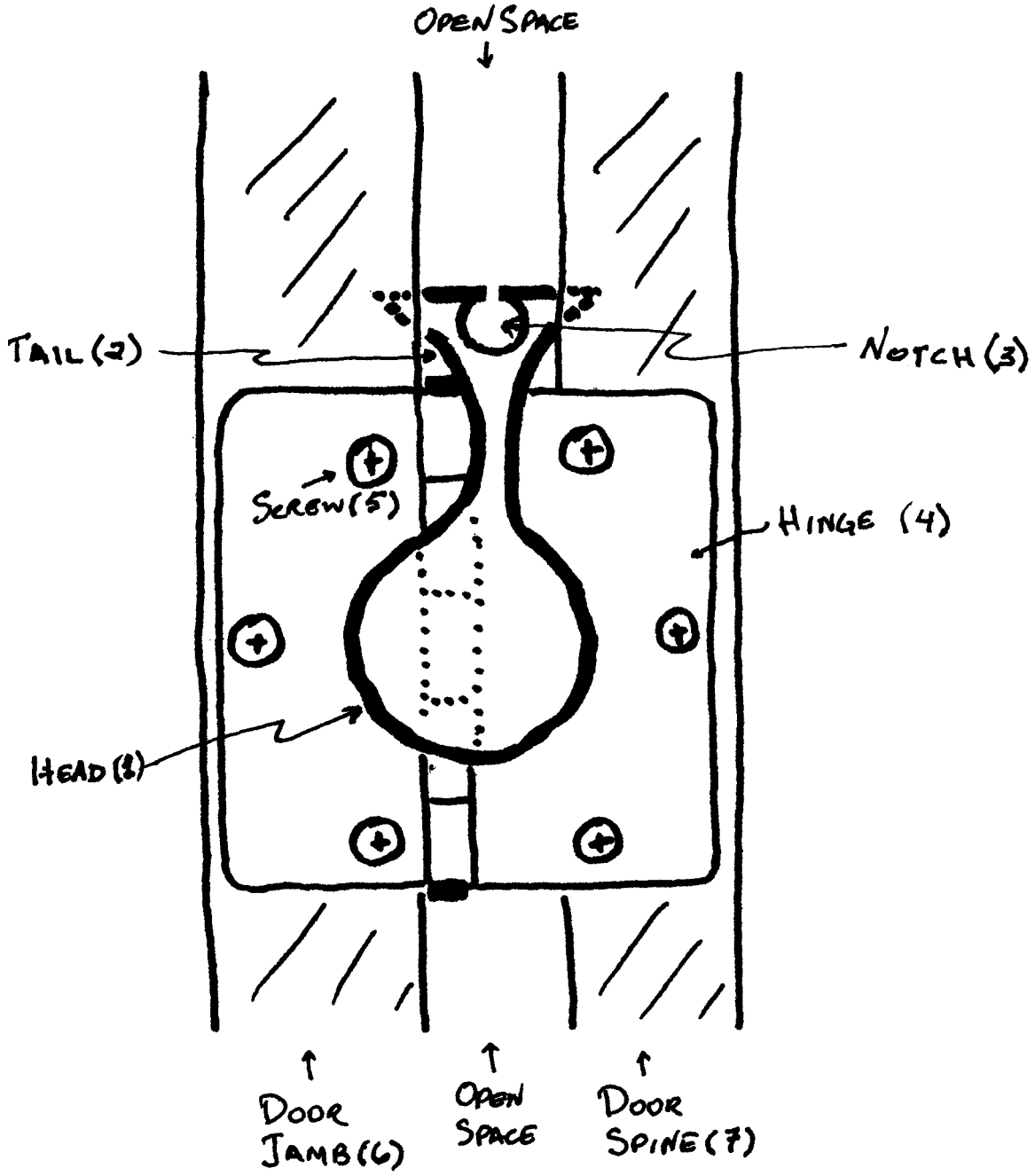
FIG. 2 Implementation—(in-place view) drawing, of door stop in place while facing an open door's jamb 6 and spine 7, and the hinge 4 that joins the door to the jamb 6.

In a preferred embodiment, as shown in FIGS. 1A and 1B, the doorstop includes a bulb-shaped head portion 1, a tail portion 2 having a proximate end connected to the head portion and a distal end spaced from the proximate end. The distal end is shaped into a triangular flare and a notch 3 is formed therein. Preferably, the doorstop is molded from non-toxic rubber into a one-piece product.

To use this item as a door stop, with the door open, simply slide the tail 2 of the item through the opening between the door's spine 7 and the door's jamb 6 above one of the hinges 4 that join the door to the jamb 6. The item will sit comfortably in this position, head 1 hanging loosely over the top of the hinge 4, while resting against both sides of the inside of the hinge 4, and the tail 2 anchoring the door stop at the back part of the hinge 4. To remove, simply grab the head 1 and lift away from the jamb 6 and spine 7 with a slight rotation of about 90 degrees to easily allow removal of the tail 2 through the space between door spine 7 and jamb 6. For storage, wrap the tail 2 of the door stop around the narrow part of the door knob and fit the tail 2, directly behind the head 1, into the notch 3 in the tail 2 (or remove and store in a separate location).

While in use, the item disallows the full closure of the door from wind or force, by using the head 1 to cushion and prevent the door spine 7 from meeting together with the door jamb 6. Because of its rubber construction, there is no damage to the door, the door spine 7, the door hinge 4 or the door jamb 6.

Mounting above any hinge 4 is acceptable but mounting on a higher hinge 4 may avoid tampering by smaller children.

The invention claimed is:

1. A doorstop comprises a rubber molded, one-piece body adapted to be placed in a gap above a hinge between a doorframe and a door to prevent the door from full closure;

said body including a bulb-shaped head portion, a tail portion having a proximate end connected to the head portion and a distal end spaced from the proximate end, said distal end having a triangular-flare shape and a notch formed therein; and wherein said head portion is adapted to be placed between two hinge plates of a door hinge to restrict full closure of the door; and wherein said tail portion is adapted to rest on top of the hinge and through the gap between the doorframe and the door; and wherein the triangular-flare distal end is adapted to keep the doorstop from falling away from the gap; and when not in use, said tail portion is adapted to wrap around a door knob such that the tail portion is inserted into the notch of the distal end to retain the doorstop in a storage position.

* * * * *